US008647159B2

(12) United States Patent
Steeves

(10) Patent No.: US 8,647,159 B2
(45) Date of Patent: Feb. 11, 2014

(54) APPARATUS AND METHOD FOR EFFECTING ELECTRICAL TERMINATION WITH A PLURALITY OF TYPES OF TERMINATION STRUCTURES

(75) Inventor: Michael C. Steeves, Garland, TX (US)

(73) Assignee: General Electric Company, Schenectady, NY (US)

( * ) Notice: Subject to any disclaimer, the term of this patent is extended or adjusted under 35 U.S.C. 154(b) by 265 days.

(21) Appl. No.: 13/036,233

(22) Filed: Feb. 28, 2011

(65) Prior Publication Data

US 2011/0217885 A1 Sep. 8, 2011

Related U.S. Application Data

(60) Provisional application No. 61/309,546, filed on Mar. 2, 2010.

(51) Int. Cl.
*H01R 11/11* (2006.01)

(52) U.S. Cl.
USPC ..... 439/798; 439/883

(58) Field of Classification Search
USPC ..... 439/798, 797, 801, 883, 860
See application file for complete search history.

(56) References Cited

U.S. PATENT DOCUMENTS

| | | | | | |
|---|---|---|---|---|---|
| 1,213,632 | A | * | 1/1917 | Hammond | 439/860 |
| 1,639,310 | A | * | 8/1927 | Richardson | 174/60 |
| 2,125,256 | A | * | 7/1938 | Fairbanks | 439/264 |
| 2,173,327 | A | * | 9/1939 | Channell | 174/9 F |
| 2,265,363 | A | * | 12/1941 | Fisher | 439/362 |
| 2,424,938 | A | * | 7/1947 | Lundy | 439/491 |
| 2,443,509 | A | * | 6/1948 | Lundy | 439/738 |
| 2,468,785 | A | * | 5/1949 | Sealey | 439/712 |
| 2,496,866 | A | * | 2/1950 | Flora | 439/857 |
| 2,540,606 | A | * | 2/1951 | Beezley | 439/805 |
| 2,682,039 | A | * | 6/1954 | Tinnerman | 439/253 |
| 2,726,375 | A | * | 12/1955 | Gordon | 439/717 |
| 2,942,232 | A | * | 6/1960 | Knocke | 439/815 |
| 2,984,817 | A | * | 5/1961 | Zeffert | 439/718 |
| 3,014,977 | A | * | 12/1961 | Geiser | 174/549 |
| 3,166,650 | A | * | 1/1965 | Heidrich | 200/52 R |
| 3,471,822 | A | * | 10/1969 | Van Baelen | 439/52 |
| 3,584,510 | A | * | 6/1971 | Harris | 374/179 |
| 3,860,314 | A | * | 1/1975 | Vandiveer et al. | 439/54 |
| 4,002,390 | A | * | 1/1977 | Perry et al. | 439/433 |
| 4,336,975 | A | * | 6/1982 | Casteel | 439/503 |
| 4,345,806 | A | * | 8/1982 | McHenney | 439/510 |
| 4,486,058 | A | * | 12/1984 | Takagi et al. | 439/92 |
| 4,643,511 | A | * | 2/1987 | Gawlik et al. | 439/755 |
| 4,795,380 | A | * | 1/1989 | Frantz | 439/860 |
| 4,846,721 | A | * | 7/1989 | Debruycker et al. | 439/411 |
| 5,023,745 | A | * | 6/1991 | Glass | 361/56 |
| 5,173,060 | A | * | 12/1992 | Shimirak et al. | 439/416 |
| 5,203,724 | A | * | 4/1993 | Casey | 439/792 |

(Continued)

*Primary Examiner* — Neil Abrams
(74) *Attorney, Agent, or Firm* — Dolly Wu; General Electric Company

(57) ABSTRACT

An apparatus for effecting electrical termination with a plurality of types of termination structures includes: (a) a base member presenting a face in a first direction; and (b) a plurality of electrically conductive connection members extending in the first direction from the face. Each respective connection member of the plurality of connection members presents a rod-shaped post. Each post has a first portion presenting a threaded structure and has a second portion presenting an unthreaded structure. The rod-shaped post of selected connection members may further include a tapped opening located along a longitudinal axis of the respective connection member.

17 Claims, 6 Drawing Sheets

(56) References Cited

U.S. PATENT DOCUMENTS

| | | | | | |
|---|---|---|---|---|---|
| 5,295,860 | A * | 3/1994 | Jozefczyk et al. | 439/503 |
| 5,308,925 | A * | 5/1994 | Paterek et al. | 174/152 GM |
| 5,649,841 | A * | 7/1997 | Martinez et al. | 439/712 |
| 5,931,708 | A * | 8/1999 | Annas et al. | 439/798 |
| 6,033,269 | A * | 3/2000 | Sekido et al. | 439/801 |
| 6,036,554 | A * | 3/2000 | Koeda et al. | 439/797 |
| 6,106,341 | A * | 8/2000 | Leach, III | 439/798 |
| 6,126,493 | A * | 10/2000 | Price et al. | 439/801 |
| 6,302,709 | B1 | 10/2001 | Ross | |
| 6,709,287 | B2 * | 3/2004 | Sims et al. | 439/559 |
| 6,769,941 | B2 * | 8/2004 | Norden | 439/798 |
| 6,946,843 | B2 * | 9/2005 | Fussell et al. | 324/418 |
| 7,056,161 | B2 * | 6/2006 | Delcourt et al. | 439/766 |
| 7,081,027 | B2 * | 7/2006 | Woodward | 439/777 |
| 7,081,589 | B1 * | 7/2006 | Advey et al. | 174/78 |
| 7,458,861 | B1 * | 12/2008 | Eke et al. | 439/798 |
| 7,527,523 | B2 * | 5/2009 | Yohn et al. | 439/564 |
| 7,578,711 | B2 * | 8/2009 | Robinson | 439/801 |
| 7,892,049 | B1 * | 2/2011 | Andler et al. | 439/801 |
| 7,955,141 | B2 * | 6/2011 | Jang et al. | 439/709 |
| 8,241,071 | B1 * | 8/2012 | Hayama | 439/709 |
| 8,360,811 | B2 * | 1/2013 | Aoki | 439/801 |
| 2001/0024911 | A1 * | 9/2001 | Bre' et al. | 439/717 |
| 2008/0026645 | A1 * | 1/2008 | Naufel et al. | 439/798 |
| 2011/0117773 | A1 * | 5/2011 | Delmas | 439/544 |
| 2012/0028509 | A1 * | 2/2012 | Aoki | 439/736 |

* cited by examiner

APPARATUS AND METHOD FOR EFFECTING ELECTRICAL TERMINATION WITH A PLURALITY OF TYPES OF TERMINATION STRUCTURES

This application claims benefit of prior filed Provisional Patent Application Ser. No. 61/309,546, filed Mar. 2, 2010.

BACKGROUND OF THE INVENTION

The present invention is directed to electrical termination structures and methods, and especially to electrical termination structures and methods accommodating a plurality of different termination structures.

In the past high power electrical termination structures have been designed to accept one type of connector such as bolted lugs or a quick-connect terminals. A user of such electrical termination structures must choose a connection technology when ordering an end product. Such a requirement for early selection of connection technology can result in a user having to maintain inventory of more than one connection technology, and could result in having to scrap connectors if a user decides to change connector technology. An installer making a connection in the field connection may have to cut off a connector from a cable if the connector is the wrong type so that the installer can put on the correct type of connector. Such an in-field replacement procedure wastes time and material.

A new connection structure is herein disclosed which allows high power connections to be made using high-power quick-connect connectors (requires no tool; completely insulated) or traditional lugs bolted to studs on the same bus bar or other connecting point. The disclosed apparatus eliminates the need to have two bus bars on a product, for example one for quick-connect connectors and another for traditional lugs, in the event the product must be designed to accept both connection methods. The disclosed apparatus presents a single connection structure utilizing dual-use posts that can be shipped to a diverse customer base. The disclosed apparatus also allows customers that may have value high reliability, proven technology and may be slow to adopt new methods the freedom to switch to a new technology at their own pace.

The disclosed apparatus' accommodation of quick-connect terminations advantageously permits easy employment of such new connection technology. High-power quick-connect connectors enable faster connections to be made with less chance for error because they do not require torqued connections. Such quick-connect connectors also uses the same crimp tooling as the terminal lugs that are used to terminate the majority of the power wiring in the telecomm industry today.

The disclosed apparatus' provision of a dual-user post aids in retrofitting a new piece of equipment into an existing application where older cabling may have terminal lug connectors and newer cabling may be outfitted with quick-connect connectors.

There is a need for an apparatus and method for effecting electrical termination that allows a user to choose between the connection technologies in the field rather than having to select during the ordering process.

There is a need for an apparatus and method for effecting electrical termination that allows a user to switch seamlessly between various termination technologies without having to abandon inventory of either power systems or connection devices.

There is a need for an apparatus and method for effecting electrical termination that allows a user to mix technologies at a site depending on availability of connectors.

There is a need for an apparatus and method for effecting electrical termination that allows a single power system design to appeal to a broader range of users who are at different stages of their acceptance of newer connector technology.

SUMMARY OF THE INVENTION

An apparatus for effecting electrical termination with a plurality of types of termination structures includes: (a) a base member presenting a face in a first direction; and (b) a plurality of electrically conductive connection members extending in the first direction from the face. Each respective connection member of the plurality of connection members presents a rod-shaped post. Each post has a first portion presenting a threaded structure and has a second portion presenting an unthreaded structure.

A method for accommodating electrical termination with a plurality of types of termination structures includes: (a) providing a bus member presenting a face in a first direction; and (b) providing a plurality of electrically conductive connection members extending in the first direction from the face. Each respective connection member of the plurality of connection members presents a rod-shaped post. Each post has a first portion presenting a threaded structure and has a second portion presenting an unthreaded structure.

It is, therefore, a feature of the present invention to provide an apparatus and method for effecting electrical termination that allows a user to choose between the connection technologies in the field rather than having to select during the ordering process.

It is another feature of the present invention to provide an apparatus and method for effecting electrical termination that allows a user to switch seamlessly between various termination technologies without stranding inventory of either power systems or connection devices.

It is still another feature of the present invention to provide an apparatus and method for effecting electrical termination that allows a user to mix technologies at a site depending on availability of connectors.

It is yet another feature of the present invention to provide an apparatus and method for effecting electrical termination that allows a single power system design to appeal to a broader range of users who are at different stages of their acceptance of newer connector technology Further features of the present invention will be apparent from the following specification and claims when considered in connection with the accompanying drawings, in which like elements are labeled using like reference numerals in the various figures, illustrating the preferred embodiments of the invention.

DETAILED DESCRIPTION OF THE PREFERRED EMBODIMENT

Figure 1:
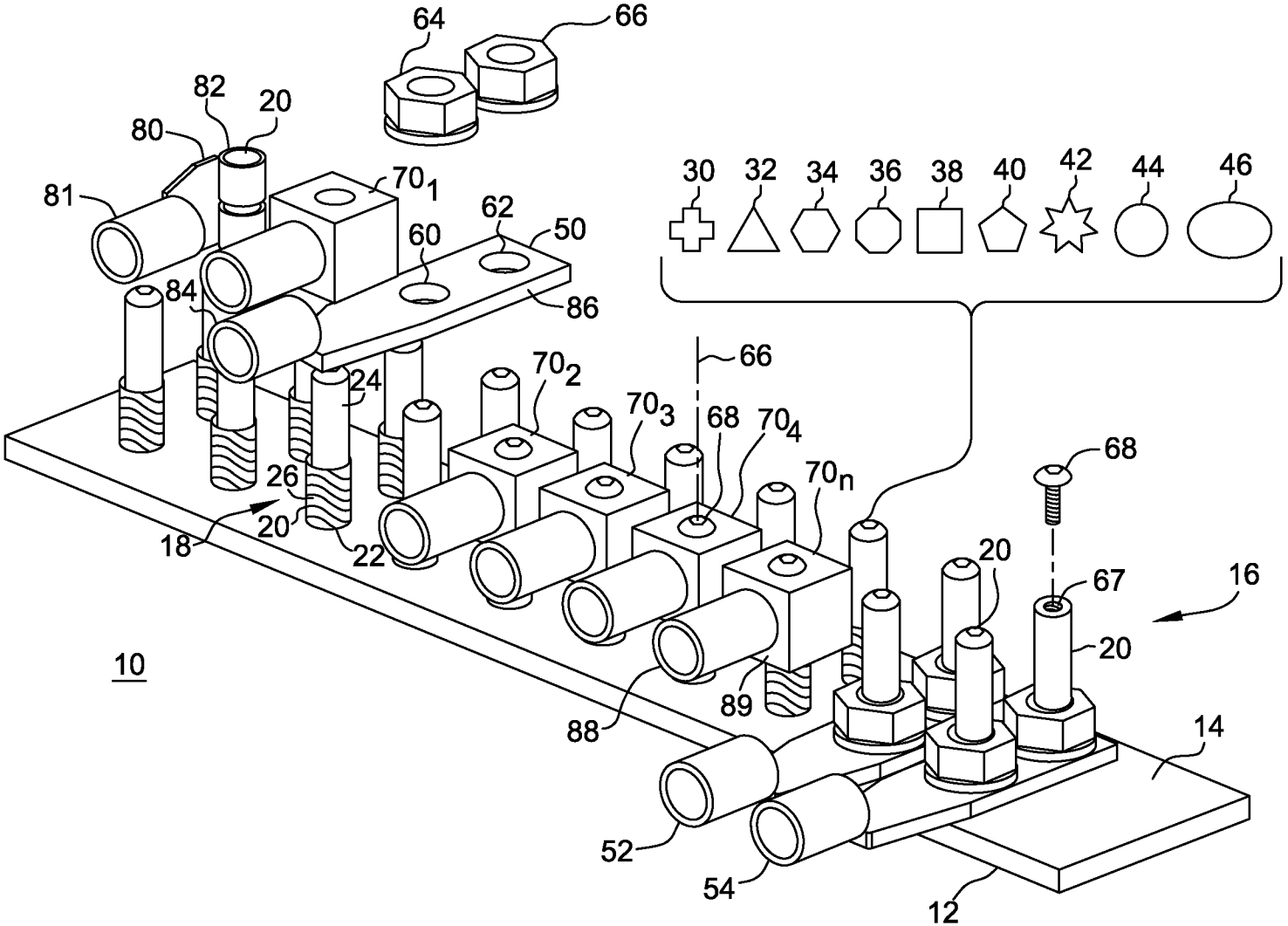
FIG. 1 is a perspective illustration of an embodiment of an electrical termination structure according to the teaching of the present application employed with first representative terminating structures.

FIG. 1 is a perspective illustration of an embodiment of an electrical termination structure according to the teaching of the present application employed with first representative terminating structures. In FIG. 1, an apparatus 10 includes a base member 12 presenting a face 14 upward in FIG. 1. A plurality of electrically conductive connection members 16 are in electrical and physical connection with base member 12 extending from face 14 upward in FIG. 1.

In the interest of avoiding prolixity and cluttering of FIG. 1, it may be considered that each respective connection member of plurality of connection members 16 is substantially the same, except as described below in connection with rod shape. Accordingly, a representative connection member 18 will be described in detail with the understanding that remaining connection members of plurality of connection members 16 are substantially similar to representative connection member 18. Connection member 18 presents a rod-shaped post 20 having a first portion 22 and a second portion 24. First portion 22 includes a male-threaded structure 26.

Rod shape in a section substantially perpendicular with a longitudinal axis 66 of respective connection members of plurality of connection members 16 may be of any rod-shape including, by way of example and not by way of limitation, a cross 30, a triangle 32, a hexagon 34, an octagon 36, a square 38, a pentagon 40, a multi-pointed star 42, a circle 44 or an ellipse 46. Distinguishing respective individual connection members 16 by a different rod-shape may be employed to facilitate distinguishing particular electrical characteristics or other characteristics of a circuit (not shown) that may be coupled with a respective connection member 16. Such an arrangement may permit, by way of example and not by way of limitation, having different voltages from different circuitry attachable only to certain connection members 16 according to shape of the rod-shaped post employed with a respective connection member 16. Shape of a rod-shaped post may thus operate to accept a certain termination structure that may accommodate or accept a particular rod shape and reject other termination structures not fitting with the selected rod. Such a discriminatory arrangement among connection members 16 may necessitate segmenting base member 14 into electrically isolated sections (not shown in FIG. 1; understood by those skilled in the art of electrical termination structure design).

Connection members 16 may be arranged in pairs to accommodate termination structures such as termination lugs 50, 52, 54. Lugs may be configured to engage a single connection member 16 (not shown in FIG. 1; understood by those skilled in the art of electrical termination structure design) either in terms of size or shape, as discussed above. Lug 50, for example, includes a terminal section 84 for crimpingly coupling with an electrical conductor (not shown in FIG. 1). Alternatively, an electrical conductor may be soldered with lug 50, or may be both soldered and crimpingly coupled with lug 50. Terminal section 84 may be coupled with (or integrally formed with) a base member 86. Apertures 60, 62 traverse base member 86 and may be proportioned to accommodate post 20 passing through apertures 60, 62. A lug (for example lug 50) may be secured with respect to base member 12 against face 14 by orienting lug 50 with each of apertures 60, 62 receiving a rod-shaped post 20 therethrough and orienting lug 54 against face 14. Thereafter, female-threaded structures, such as by way of example and not by way of limitation, nuts 64, 66 may each receive a rod-shaped post therethrough and may be threadedly engaged with male-threaded structures 26 on first portions 22 of rod-shaped posts 20. Threadedly tightening nuts 64, 66 on male threaded structures 26 may securely orient lug 54 with respect to base member 12, both in a physical sense and in an electrical sense.

Electrical terminations with connection members 16 may also be effected using quick connect terminations such as quick connect terminations $\mathbf{70}_1$, $\mathbf{70}_2$, $\mathbf{70}_3$, $\mathbf{70}_4$, $\mathbf{70}_n$. A quick connect termination member may be configured to connect with two posts 20 in a manner similar to lugs 50, 52, 54 (not shown in FIG. 1; understood by those skilled in the art of electrical termination structure design). The indicator "n" is employed to signify that there can be any number of quick connect terminations used in connection with apparatus 10. The inclusion of five quick connect terminations $\mathbf{70}_1$, $\mathbf{70}_2$, $\mathbf{70}_3$, $\mathbf{70}_4$, $\mathbf{70}_n$ in FIG. 1 is illustrative only and does not constitute any limitation regarding the number of quick connect terminations that may be included in the electrical termination apparatus of the present invention.

Throughout this description, use of a reference numeral using a generic subscript herein may be taken to mean that any respective member of the plurality of elements having the same reference numeral may be regarded as included in the description. Thus, by way of example and not by way of limitation, referring to quick connect termination $\mathbf{70}_n$ in describing FIG. 1 may be taken to mean that any quick connect termination—$\mathbf{70}_1$, $\mathbf{70}_2$, $\mathbf{70}_3$, $\mathbf{70}_4$, $\mathbf{70}_n$ (FIG. 1)—may be regarded as capable of employment as described.

Quick connect termination $\mathbf{70}_n$ may be of a type having an aperture or channel having an internal wall and containing a deformable member therein. Quick connect termination $\mathbf{70}_n$ may be configured to receive second portion 24 of rod-shaped post 20 within the channel, thereby capturing the deformable member between the channel wall and post 20. Quick connect termination $\mathbf{70}_n$, for example, includes a terminal section 88 for crimpingly coupling with an electrical conductor (not shown in FIG. 1). Terminal section 88 may be coupled with (or integrally formed with) a base member 89. This type of connector or termination structure is described in greater detail below in connection with FIGS. 3-5.

Quick connect termination $\mathbf{70}_n$ may be installed on connection post 20 by pushing quick connector termination $\mathbf{70}_n$ onto post 20 to forcibly insert second portion 24 within the channel (not shown in FIG. 1) of quick connect termination $\mathbf{70}_n$.

One may note that an advantageous feature of electrical termination apparatus 10 is that a given connection post 20 may accommodate and terminate two different types of electrical termination at the same time. By way of example and not by way of limitation, a post 20 may threadedly secure a lug 50 against face 14, as described above, and leave an exposed portion of second portion 24 available to receive a quick connect termination $\mathbf{70}_n$ on the same post 20. This simultaneous installation of two types of connector is not illustrated in FIG. 1, but is well understood by those skilled in the art of electrical termination structure design.

Alternatively, a post 20 may be bored substantially along a longitudinal is such as axis 66 to establish a receiver aperture 67 to accommodate insertion of a fastener 68 to further secure a quick connect termination 70*n* with a post 20. Fastener 68 may be, by way of example and not by way of limitation, a threaded fastener (in which case the aperture may be tapped to receive threads), a rivet or a similar fastener. Fastener 68 may also be employed to secure a termination configured in a structure similar to quick connect termination 70*n* but without a deformable member.

Another alternate termination structure 80 is illustrated in FIG. 1. Termination 80 includes a terminal section 81 for crimpingly coupling with an electrical conductor (not shown in FIG. 1). Termination 80 may be another quick connect termination having a deformable element (not shown in FIG. 1) within a channel 82 into which post 20 may be inserted, thereby capturing the deformable member between a wall of channel 82 and post 20.

Figure 2:
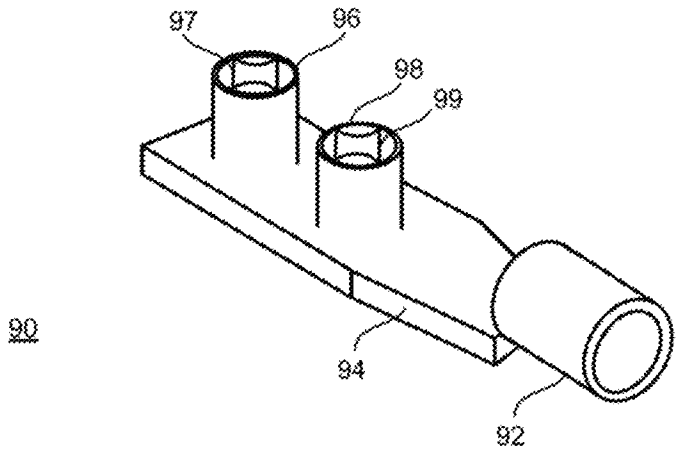
FIG. 2 is a perspective illustration of another representative terminating structure.

FIG. 2 is a perspective illustration of another representative terminating structure. In FIG. 2, a termination 90 includes a terminal section 92 for crimpingly coupling with an electrical conductor (not shown in FIG. 2). Terminal section 92 is coupled with (or integrally formed with) a base member 94. Termination 90 has two channels 96, 98 traversing base member 94. Channel 96 contains a deformable element 97. Channel 98 contains a deformable element 99. Termination 90 may be another quick connect termination configured to receive connection members such as posts 20 (FIG. 1) to capture deformable elements 97, 99 within channels 96, 98.

Figure 3:
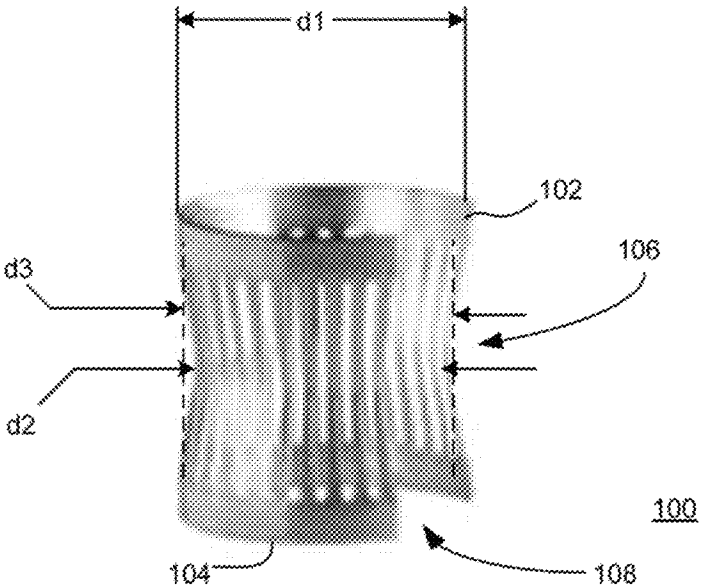
FIG. 3 is a perspective illustration of a deformable termination element that may be employed with the present invention.
Figure 4:
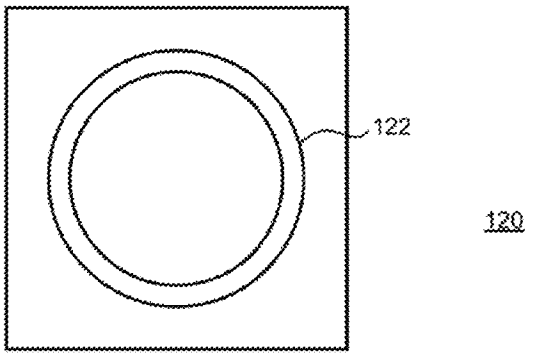
FIG. 4 is a top view of a representative connection structure that may be employed with the present invention.
Figure 5:
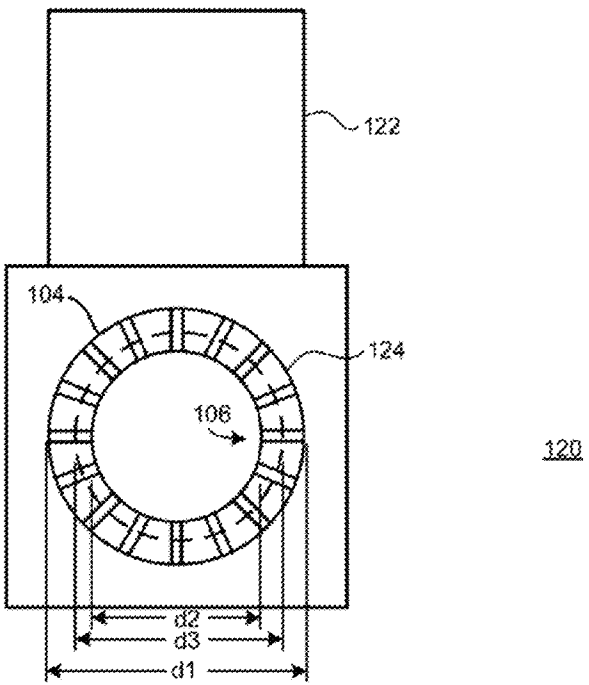
FIG. 5 is a side elevation view of the connection structure illustrated in FIG. 5.

FIG. 3 is a perspective illustration of a deformable termination element that may be employed with the present invention. FIG. 4 is a top view of a representative connection structure that may be employed with the present invention. FIG. 5 is a side elevation view of the connection structure illustrated in FIG. 5. Regarding FIGS. 3-5 together, a deformable element 100 sometimes referred to as a "crown band" element is fashioned from an electrically conductive material, such as a metal, and configured to present an upper band 102 and a lower band 104 connected by a web structure 106. Element 100 is provided with a split structure having a vacant juncture 108. Vacant juncture 108 permits compression of element 100 to facilitate fitting element 100 within a channel. A housing 120 (see FIGS. 4 and 5) includes a terminal section 122 for crimpingly or otherwise fixing an electrical lead (not shown in FIGS. 4-5; understood by those skilled in the art of electrical termination structure design) within housing 120.

Flexible element 100 has a diameter d1 established by upper band 102 and lower band 104. Element 100 has a second diameter d2 across the minimum expanse of web structure 106 when element 100 is installed within a channel (see FIG. 5).

Housing 120 also includes a channel 124. A flexible element such as a crown band element 100 may be flexed to compress element 100 to effect closing flexible juncture 108 to establish a temporary diameter less than the diameter d1 of channel 124. When flexible element 100 is situated in channel 124, compression of element 100 may be relaxed so that element 100 may expand against channel 124 so that diameters of upper band 102 and lower band 104 are substantially equal with inner diameter d1 of channel 124.

When a contact member of an appropriate size (such as a post 20; FIG. 1) is inserted within channel 124 when a flexible element 100 is installed, the minimum expanse of web structure 106 encounters the contact member and is deflected to a larger diameter to accommodate the contact member so that web structure 106 has a minimum diameter d3 when a contact member is inserted within channel 124. When a contact member of an appropriate size is installed or inserted within channel 124, $$d1 > d3 > d2 \quad [1]$$

Flexible element 100 responds to being deflected by applying a force against an inserted contact member to retain the inserted contact member within channel 124. Channel 124 intersects terminal section 122 so that an electrical lead fixed within terminal section 122 will be in electrical contact with a contact member captured within channel 124.

Figure 6:
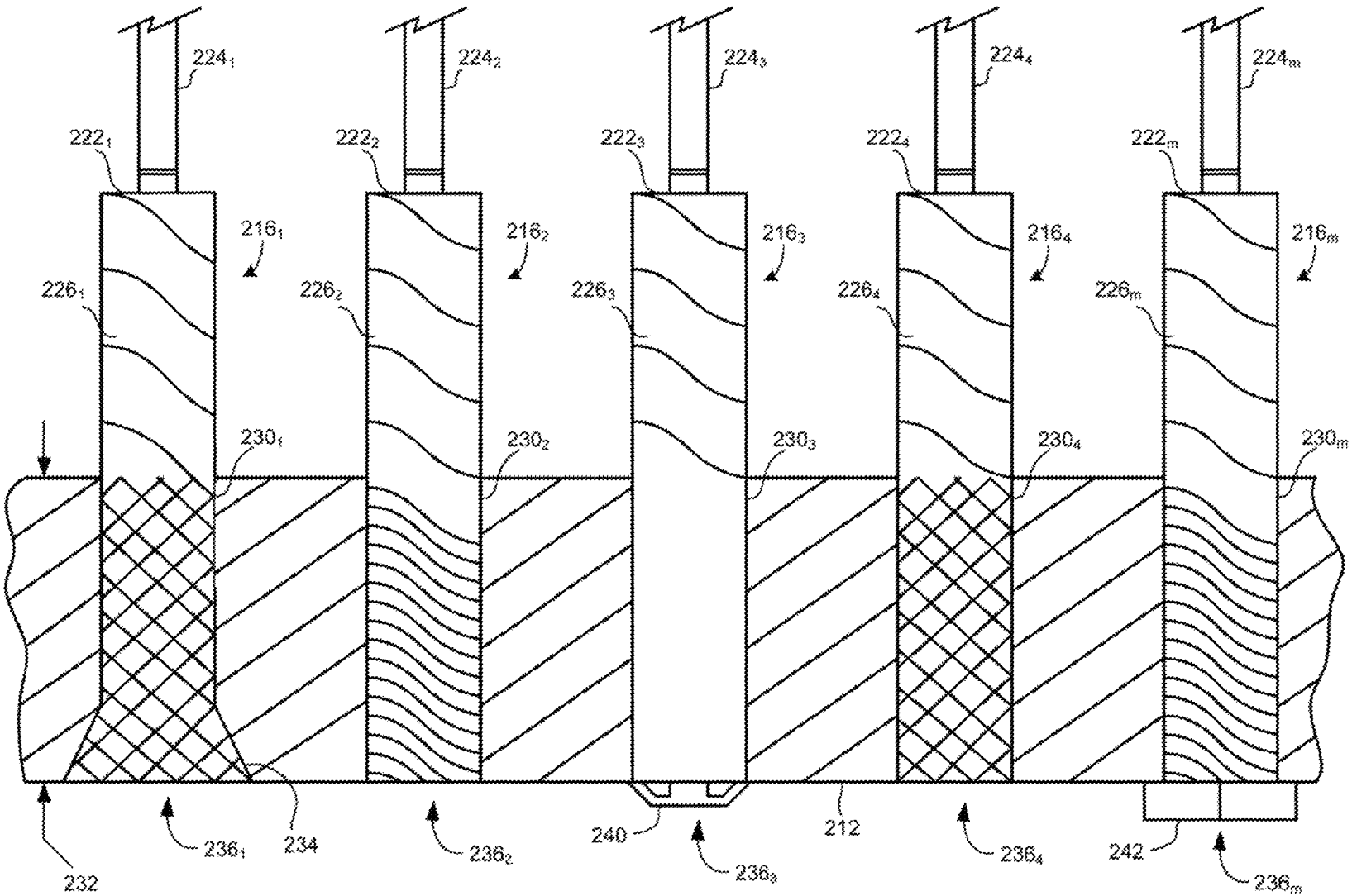
FIG. 6 is a plan elevation view of a representative variety of techniques for affixing connection posts with a bus bar structure.

FIG. 6 is a plan elevation view of a representative variety of techniques for affixing connection posts with a bus bar structure. In FIG. 6, a base member 212 is presented in a section view illustrating installation of connection members $\mathbf{216}_1$, $\mathbf{216}_2$, $\mathbf{216}_3$, $\mathbf{216}_4$, $\mathbf{216}_m$. The indicator "m" is employed to signify that there can be any number of ways to install connection members for use in connection with the present invention. The inclusion of five types of installations of connection members $\mathbf{216}_1$, $\mathbf{216}_2$, $\mathbf{216}_3$, $\mathbf{216}_4$, $\mathbf{216}_m$ in FIG. 6 is illustrative only and does not constitute any limitation regarding the number of types of installations of connection members that may be employed in connection with the present invention.

Connection member $\mathbf{216}_1$ includes a rod-shaped post $\mathbf{220}_1$ having a having a first portion $\mathbf{222}_1$ and a second portion $\mathbf{224}_1$. First portion $\mathbf{222}_1$ includes a male-threaded structure $\mathbf{226}_1$. An engaging portion $\mathbf{230}_1$ of connection member $\mathbf{216}_1$ is situated to traverse base member 212 when connection member $\mathbf{216}_1$ is in an installed orientation (illustrated in FIG. 6) with respect to base member 212. Engaging portion $\mathbf{230}_1$ is serrated or knurled over at least a portion of an engagement expanse 232 at which engaging portion $\mathbf{230}_1$ engages base member 212 in the installed orientation. Engaging portion $\mathbf{230}_1$ includes a head portion 234. An accommodating aperture $\mathbf{236}_1$ traversing base member 212 for receiving connection member $\mathbf{216}_1$ may be countersunk to accommodate head portion 234 in the installed orientation. Connection member $\mathbf{216}_1$ may be installed by press-fitting connection member $\mathbf{216}_1$ into accommodating aperture $\mathbf{236}_1$ to the installed orientation.

Connection member $\mathbf{216}_2$ includes a rod-shaped post $\mathbf{220}_2$ having a having a first portion $\mathbf{222}_2$ and a second portion $\mathbf{224}_2$. First portion $\mathbf{222}_2$ includes a male-threaded structure $\mathbf{226}_2$. An engaging portion $\mathbf{230}_2$ of connection member $\mathbf{216}_2$ is situated to traverse base member 212 when connection member $\mathbf{216}_2$ is in an installed orientation (illustrated in FIG. 6) with respect to base member 212. Engaging portion $\mathbf{230}_2$ is threaded over at least a portion of an engagement expanse 232 at which engaging portion $\mathbf{230}_2$ engages base member 212 in the installed orientation. An accommodating aperture $\mathbf{236}_2$ traversing base member 212 for receiving connection member $\mathbf{216}_2$ may be threaded to accommodate the threaded configuration of engaging portion $\mathbf{230}_2$ in the installed orientation. Connection member $\mathbf{216}_2$ may be installed by rotatingly installing or screwing connection member $\mathbf{216}_2$ into accommodating aperture $\mathbf{236}_2$ to the installed orientation.

Connection member $\mathbf{216}_3$ includes a rod-shaped post $\mathbf{220}_3$ having a having a first portion $\mathbf{222}_3$ and a second portion $\mathbf{224}_3$. First portion $\mathbf{222}_3$ includes a male-threaded structure $\mathbf{226}_3$. An engaging portion $\mathbf{230}_3$ of connection member $\mathbf{216}_3$ is situated to traverse base member 212 when connection member $\mathbf{216}_3$ is in an installed orientation (illustrated in FIG. 6) with respect to base member 212. Engaging portion $\mathbf{230}_3$ engages base member 212 over at least a portion of an engagement expanse 232 in the installed orientation. Engaging portion $\mathbf{230}_3$ includes a rivet structure 240. An accommodating aperture $\mathbf{236}_3$ traversing base member 212 is provided for receiving connection member $\mathbf{216}_3$ in the installed orientation. Connection member $\mathbf{216}_3$ may be installed by pressing connection member $216_3$ into accommodating aperture $236_3$ to the installed orientation and rolling or otherwise deforming rivet structure 240 to secure connection member $216_3$ within accommodating aperture $236_3$.

Connection member $216_4$ includes a rod-shaped post $220_4$ having a having a first portion $222_4$ and a second portion $224_4$. First portion $222_4$ includes a male-threaded structure $226_4$. An engaging portion $230_4$ of connection member $216_4$ is situated to traverse base member 212 when connection member $216_4$ is in an installed orientation (illustrated in FIG. 6) with respect to base member 212. Engaging portion $230_4$ is serrated or knurled over at least a portion of an engagement expanse 232 at which engaging portion $230_4$ engages base member 212 in the installed orientation. Connection member $216_4$ may be installed by press-fitting connection member $216_4$ into an accommodating aperture $236_4$ to the installed orientation.

Connection member $216_m$ includes a rod-shaped post $220_m$ having a having a first portion $222_m$ and a second portion $224_m$. First portion $222_m$ includes a male-threaded structure $226_m$. An engaging portion $230_m$ of connection member $216_m$ is situated to traverse base member 212 when connection member $216_m$ is in an installed orientation (illustrated in FIG. 6) with respect to base member 212. Engaging portion $230_m$ is threaded over at least a portion of an engagement expanse 232 at which engaging portion $230_m$ engages base member 212 in the installed orientation. An accommodating aperture $236_m$ traversing base member 212 for receiving connection member $216_m$ may be threaded to accommodate the threaded configuration of engaging portion $230_m$ in the installed orientation. Connection member $216_m$ may include an integral or attached head structure 242. Connection member $216_m$ may be installed by applying a rotating force to head structure 242 to effect rotatingly installing or screwing connection member $216_m$ into accommodating aperture $236_m$ to the installed orientation.

Figure 7:
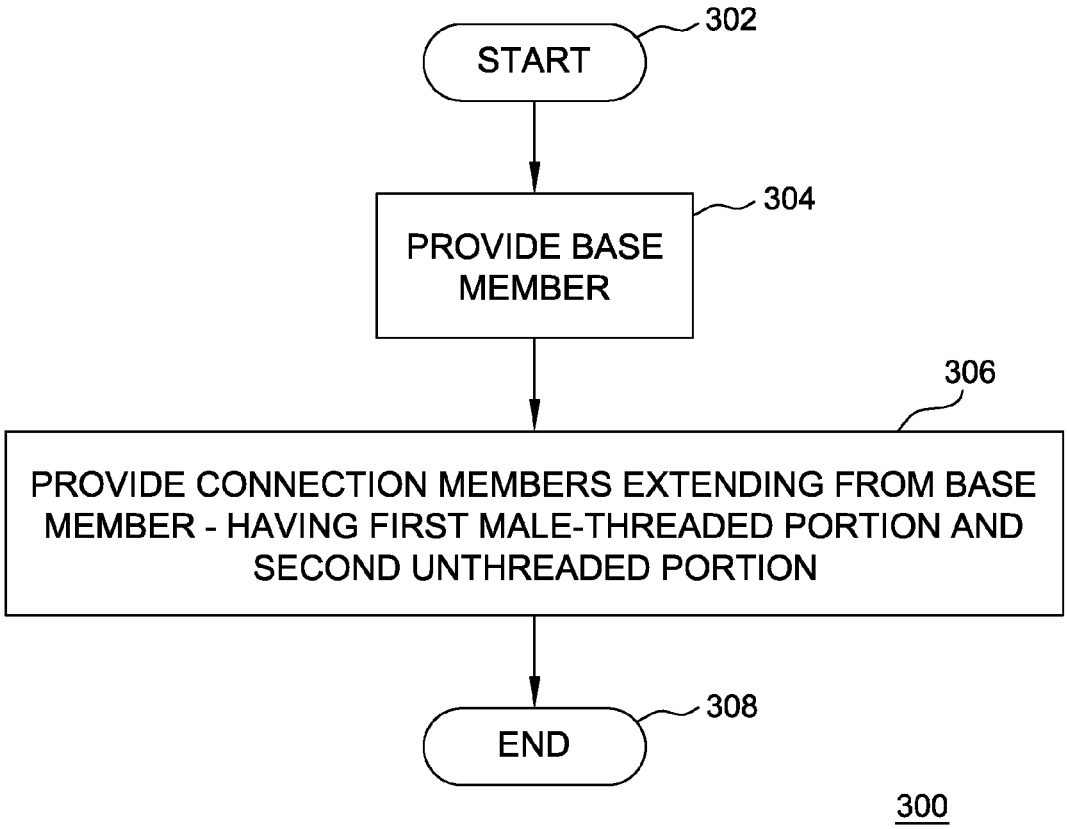
FIG. 7 is a flow chart illustrating the method of the present invention.

FIG. 7 is a flow chart illustrating the method of the present invention. In FIG. 7, a method 300 for accommodating electrical termination with a plurality of types of termination structures begins at a START locus 302.

Method 300 continues with providing a bus member, as indicated by a block 304. The base member presents a face in a first direction (e.g., upward in FIG. 1).

Method 300 continues with providing a plurality of electrically conductive connection members extending in the first direction from the face, as indicated by a block 306. Each respective connection member of the plurality of connection members presents a rod-shaped post. Each post has a first portion presenting a male-threaded structure and has a second portion presenting an unthreaded structure.

Method 300 terminates at an END locus 308.

One may observe that the apparatus and method of the present invention effects electrical termination that allows a user to choose between the connection technologies in the field rather than having to select during the ordering process.

One may also observe that the apparatus and method of the present invention effects electrical termination that allows a user to switch seamlessly between various termination technologies without having to abandon inventory of either power systems or connection devices.

One may further observe that the apparatus and method of the present invention effects electrical termination that allows a user to mix technologies at a site depending on availability of connectors.

One may still further observe that the apparatus and method of the present invention effects electrical termination that allows a single power system design to appeal to a broader range of users who are at different stages of their acceptance of newer connector technology.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

I claim:

1. An apparatus for effecting electrical termination with a plurality of types of termination structures; the apparatus comprising:

a base member; said base member presenting a planar surface in a first direction; and a plurality of electrically conductive connection members extending in said first direction from said planar surface, each respective connection member of said plurality of connection members presenting a rod-shaped post comprising:

a first portion presenting a male-threaded structure, said first portion configured to receive a first termination structure; and a second portion presenting an unthreaded structure, said second portion configured to receive a second termination structure different from said first termination structure, wherein said each respective connection member is oriented substantially symmetrically about a longitudinal axis, said longitudinal axis of each said each respective connection member being oriented substantially parallel to each other, said each respective connection member being tapped substantially along said longitudinal axis to receive a threaded fastener configured to secure a respective said second termination structure to said second portion of said each respective connection member.

2. The apparatus for effecting electrical termination with a plurality of types of termination structures as recited in claim 1 wherein said first portion is configured to secure said first termination structure by threadedly engaging a female-threaded structure with said male-threaded structure.

3. The apparatus for effecting electrical termination with a plurality of types of termination structures as recited in claim 1 wherein said second portion receives said second termination structure in surrounding relation about said second portion along a length of said second portion; said second portion and said second termination structure cooperating to compressively capture a deformable termination element between said second portion and said second termination structure substantially along said length.

4. The apparatus for effecting electrical termination with a plurality of types of termination structures as recited in claim 1 wherein said first portion is configured to secure said first termination structure by threadedly engaging a female-threaded structure with said male-threaded structure.

5. The apparatus for effecting electrical termination with a plurality of types of termination structures as recited in claim 1 wherein said second portion receives said second termination structure in surrounding relation about said second portion along a length of said second portion; said second portion and said second termination structure cooperating to compressively capture a deformable termination element between said second portion and said second termination structure substantially along said length.

6. The apparatus for effecting electrical termination with a plurality of types of termination structures as recited in claim 4 wherein said second portion receives said second termination structure in surrounding relation about said second portion along a length of said second portion; said second portion and said second termination structure cooperating to compressively capture a deformable termination element between said second portion and said second termination structure substantially along said length.

7. An apparatus configured for electrical termination with a plurality of types of termination structures; the apparatus comprising:

a bus member presenting a planar surface in a first direction; and a plurality of electrically conductive connection members electrically common with said bus member and extending in said first direction from said planar surface, each respective connection member of said plurality of connection members presenting a rod-shaped post having a threaded first portion to engage a termination lug and an unthreaded second portion to connect to a quick-connect termination connector, said threaded first portion and said unthreaded second portion coaxially oriented about a respective common axis, wherein said each respective connection member is tapped substantially along said respective common axis to receive a threaded fastener configured to secure a respective said quick-connect termination connector to said unthreaded second portion of said each respective connection member.

8. The apparatus configured for electrical termination with a plurality of types of termination structures as recited in claim 7 wherein said threaded first portion is configured to secure said termination lug by threadedly engaging a threaded fastener with said threaded first portion.

9. The apparatus configured for electrical termination with a plurality of types of termination structures as recited in claim 7 wherein said unthreaded second portion receives said quick-connect termination connector in surrounding relation about said unthreaded second portion along a length of said unthreaded second portion; said unthreaded second portion and said quick-connect termination connector cooperating to compressively capture a deformable termination element between said unthreaded second portion and said quick-connect termination connector substantially along said length.

10. The apparatus configured for electrical termination with a plurality of types of termination structures as recited in claim 7 wherein said first portion is configured to secure said termination lug by threadedly engaging a threaded fastener with said threaded first portion.

11. The apparatus configured for electrical termination with a plurality of types of termination structures as recited in claim 7 wherein said unthreaded second portion receives said quick-connect termination connector in surrounding relation about said unthreaded second portion along a length of said unthreaded second portion; said unthreaded second portion and said quick-connect termination connector cooperating to compressively capture a deformable termination element between said unthreaded second portion and said second termination structure quick-connect termination connector substantially along said length.

12. The apparatus configured for electrical termination with a plurality of types of termination structures as recited in claim 10 wherein said unthreaded second portion receives said quick-connect termination connector in surrounding relation about said unthreaded second portion along a length of said unthreaded second portion; said unthreaded second portion and said quick-connect termination connector cooperating to compressively capture a deformable termination element between said unthreaded second portion and said quick-connect termination connector substantially along said length.

13. A method for accommodating electrical termination with a plurality of types of termination structures; the method comprising:

providing a base member; said base member presenting a face in a first direction; and providing a plurality of electrically conductive connection members extending in said first direction from said face, each respective connection member of said plurality of connection members presenting a rod-shaped post having a first portion presenting a male-threaded structure configured to engage a first termination structure, and having a second portion presenting an unthreaded structure configured to engage a second termination structure different from said first termination structure, wherein said each respective connection member is oriented substantially symmetrically about a longitudinal axis, said longitudinal axis of each said each respective connection member being oriented substantially parallel to each other, said each respective connection member tapped substantially along said longitudinal axis to receive a threaded fastener configured to secure a respective said second termination structure to said second portion of said each respective connection member.

14. The method for accommodating electrical termination with a plurality of types of termination structures as recited in claim 13 wherein said first portion is configured to secure said first termination structure by threadedly engaging a female-threaded structure with said male-threaded structure.

15. The method for accommodating electrical termination with a plurality of types of termination structures as recited in claim 13 wherein said second portion receives said second termination structure in surrounding relation about said second portion along a length of said second portion; said second portion and said second termination structure cooperating to compressively capture a deformable termination element between said second portion and said second termination structure substantially along said length.

16. The method for accommodating electrical termination with a plurality of types of termination structures as recited in claim 13 wherein said first portion is configured to secure said first termination structure by threadedly engaging a female-threaded structure with said male-threaded structure.

17. The method for accommodating electrical termination with a plurality of types of termination structures as recited in claim 16 wherein said second portion receives said second termination structure in surrounding relation about said second portion along a length of said second portion; said second portion and said second termination structure cooperating to compressively capture a deformable termination element between said second portion and said second termination structure substantially along said length.

* * * * *

UNITED STATES PATENT AND TRADEMARK OFFICE

CERTIFICATE OF CORRECTION

PATENT NO. : 8,647,159 B2
APPLICATION NO. : 13/036233
DATED : February 11, 2014
INVENTOR(S) : Steeves It is certified that error appears in the above-identified patent and that said Letters Patent is hereby corrected as shown below:

In the Specifications:

In Column 3, Line 53, delete “base member 14” and insert -- base member 12 --, therefor.

In Column 4, Line 67, delete “is” and insert -- axis --, therefor.

In the Claims:

In Column 10, Line 29, in Claim 13, delete “tapped” and insert -- being tapped --, therefor.

Signed and Sealed this
Thirteenth Day of May, 2014

Michelle K. Lee

Michelle K. Lee
*Deputy Director of the United States Patent and Trademark Office*